US012709948B2

(12) United States Patent
Senych et al.

(10) Patent No.: US 12,709,948 B2
(45) Date of Patent: Aug. 18, 2026

(54) TETHER ROLLER APPARATUS

(71) Applicant: EddyFi Canada Inc., Quebec (CA)

(72) Inventors: Craig William Senych, Quebec (CA); Anthony Bibeau, Quebec (CA); Richelle Joy Eck, Quebec (CA); Shaun Trevor Moody, Quebec (CA); Max David Douglas Mitchell, Quebec (CA)

(73) Assignee: EddyFi Canada Inc., Quebec (CA)

( * ) Notice: Subject to any disclaimer, the term of this patent is extended or adjusted under 35 U.S.C. 154(b) by 438 days.

(21) Appl. No.: 18/391,901

(22) Filed: Dec. 21, 2023

(65) Prior Publication Data

US 2025/0207467 A1 Jun. 26, 2025

(51) Int. Cl.
*E21B 17/10* (2006.01)

(52) U.S. Cl.
CPC ..... *E21B 17/1057* (2013.01)

(58) Field of Classification Search
CPC ..... E21B 17/1057; E21B 23/14
See application file for complete search history.

(56) References Cited

U.S. PATENT DOCUMENTS 484,947 A * 10/1892 Black ..... E21B 17/1057 166/241.3
4,249,810 A 2/1981 O'Connor et al.
6,250,394 B1 * 6/2001 Mashburn ..... E21B 17/1057 166/241.6
8,733,455 B2 5/2014 Shaikh et al.
9,435,169 B2 9/2016 Wheater et al.
10,648,245 B2 5/2020 Wheater et al.
10,920,502 B2 2/2021 Al-Qasim et al.
11,668,140 B2 6/2023 Church et al.
2012/0255744 A1 * 10/2012 Shaikh ..... E21B 17/1057 166/241.1
2013/0292183 A1 11/2013 Eidem et al.
2015/0027729 A1 1/2015 Hradecky
2015/0119498 A1 4/2015 Seegel et al.
2017/0067299 A1 * 3/2017 Copold ..... E21B 17/1057
2021/0002967 A1 1/2021 Vasireddy et al.
2022/0127920 A1 4/2022 Wheater et al.

OTHER PUBLICATIONS

Search Report issued by the European Patent Office for corresponding EP Patent Application No. 24 15 4710, issued Jun. 14, 2024.

* cited by examiner

*Primary Examiner* — D. Andrews
(74) *Attorney, Agent, or Firm* — GREER BURNS & CRAIN , LTD.

(57) ABSTRACT

A cost-effective, lightweight, and easily attachable/detachable cable tether apparatus to increase the run distance of a tether cable thereby overcoming factors such as pipe geometry and cumulative pipe bend angle. The apparatus includes two clamshell-like wheels pivotably joined about a hinge with a quick-release mechanism configured for selectively locking and unlocking the apparatus at varied intervals along the tether cable. The tether cable being releasably affixed to the apparatus at a location offset below the axis of rotation of the wheels.

12 Claims, 7 Drawing Sheets

TETHER ROLLER APPARATUS

TECHNICAL FIELD

The invention relates to friction reduction for tether lines. More specifically, the invention involves a roller apparatus for rapid attachment and removal to tether lines within industrial settings.

BACKGROUND OF THE ART

In the art of cable mechanics, sending cables through a conduit in the presence of curves and bends subjects the cable to friction. Such friction is also present in situations where the cable is moved or otherwise wrapped around a cylindrical surface. Depending upon the given geometries involved in the surface curvatures and tension placed upon the cable, the resultant friction may hinder or otherwise effectively prevent movement of the cable should the friction become excessive. This becomes more problematic over increasing lengths of cable being moved over curves and bends. This is well known in the art as the capstan effect.

In the context of cable tethers, the distance limitation introduced by the capstan effect is often addressed by the use of low friction tether jacket materials although with limited success. Moreover, the current state of the art for pipe inspection runs is distance-limited by tether friction with the pipe due to tether weight and cumulative pipe bend angle navigated during a run. The capstan effect increases the tether friction for every degree of bend navigated and decreases the useful length of run. To overcome such detrimental effects on a cable or similar structures within industrial settings, there have been numerous attempts to reduce related friction.

One such related attempt is shown by U.S. Pat. No. 8,733,455 to Shaikh et al. granted on May 27, 2014, and which discloses roller standoff assemblies and devices to facilitate disposal of an interior tubular member within an exterior tubular member. Roller standoff devices include a roller cage and at least one roller supported by the roller cage to contact and roll upon the exterior tubular member. However, the roller cages are complex, heavy, and difficult to rapidly attach and detach from the given tubular member.

Another such related attempt is shown by U.S. Pat. No. 10,648,245 to Wheater et al. granted on May 12, 2020, and which discloses a low friction wireline standoff purporting to improve wireline cable performance during borehole logging operations. The use of low friction wireline standoffs is intended to ameliorate the effects of wireline cable differential sticking, wireline cable key-seating, and high wireline cable drags, by reducing or eliminating contact of the wireline cable with the borehole wall during the logging operation. The low friction wireline standoff comprises external wheels mounted on two finned half shells that clamp onto the wireline with precision cable inserts which are manufactured to fit a wide range of logging cables. The wheels are intended to reduce the cable drag down-hole resulting in lower surface logging tensions, purportedly aiding conveyance in deep and deviated wells. Again however, the standoff is a complex and heavy device and difficult to rapidly attach and detach from the given wireline cable.

Still another such related attempt is shown by U.S. Pat. No. 10,920,502 to Al-Qasim et al. granted on Feb. 16, 2021 and which discloses systems and methods for reducing friction between a casing string and a bore of a subterranean well when moving the casing string within the bore of a subterranean well include a roller bearing assembly. The roller bearing assembly has a bearing body and a plurality of spherical bearings spaced around an outer diameter of the bearing body. The bearing body is sized to be removably attached to an outer diameter of the casing string and to be stationary relative to the casing string. While purportedly removable, the roller bearing assembly is yet still relatively complex and heavy device and, due to the presence of multiple lateral attachment members in the form of threaded bolts, is difficult to rapidly attach and detach from the given casing string.

Yet still another such related attempt is shown by US Patent Application Publication Number 2013/0292183 to Eidem et al. published on Nov. 7, 2013 and which discloses a centralizer that includes a centralizer body to be situated at the outer surface of a pipe string in the form of casing, liner, or the like used while drilling, the centralizer body being formed with a plurality of outer centralizer blades arranged in an inclined manner to the longitudinal axis thereof, wherein the centralizer body has an separate split inner tube secured to the pipe string by means of a press fit, and low friction inner surface of the centralizer body and separate center tube facing each other are made from low friction material. However, the centralizer is complex and heavy device and due to the presence of multiple fastening screws, is difficult to rapidly attach and detach from the given pipe string.

None of the prior art attempts have overcome the detrimental effects of friction on a cable within industrial settings for a cable intended to move through the conduit, bore, or over a curved surface. As well, none of the prior art attempts have provided quick attachment/detachment without the need for tools. For these and other reasons, there is a need for improvements directed to effective and efficient cable movement to overcome or otherwise ameliorate friction present in situations where the cable is moved or otherwise wrapped around a curved surface.

SUMMARY

As embodied and broadly described herein, the present disclosure provides a cost-effective, lightweight, and easily attachable/detachable cable tether apparatus to increase the run distance of a tether cable thereby overcoming factors such as pipe geometry and cumulative pipe bend angle. The apparatus includes two clamshell-like wheels pivotably joined about a hinge with a quick-release mechanism configured for selectively locking and unlocking the apparatus at varied intervals along the tether cable. The tether cable being releasably affixed to the apparatus at a location offset below the axis of rotation of the wheels.

According to a broad aspect, there is provided a tether roller apparatus for maintaining a tether at a distance from a curved surface, the apparatus comprising: a pair of semi-spherical wheels; a female axle portion rotatably coupled to one of the pair of semi-spherical wheels; a male axle portion rotatably coupled to another of the pair of semi-spherical wheels; and a hinge for pivotably coupling the female axle portion and the male axle portion; wherein the female axle portion and the male axle portion are movable about the hinge between a locked position thereby immovably engaging a tether and an unlocked position thereby disengaging the tether.

The apparatus may further include a tether retaining section formed by the female axle portion and the male axle portion. The tether retaining section may be a grip layer comprised of a non-slip material. The tether retaining section may be integrally formed with surfaces of the female axle portion and the male axle portion. The female axle portion may include at least one cavity and the male axle portion includes at least one barb for releasably connecting with the at least one cavity. The pair of semi-spherical wheels may be separated by a gap, and the at least one barb when fully engaged with the at least one cavity is accessible via the gap by a user of the apparatus. The tether retaining section may be offset from an axis about which the pair of semi-spherical wheels rotate.

The male axle portion may include a first barb mounted at an end of a first extension and a second barb mounted at an end of a second extension and, correspondingly, the female axle portion includes a first cavity and a second cavity, where the first barb and the first cavity when connected to one another are located opposite the axis from the second barb and the second cavity when connected to one another. The first extension and the second extension may be compressible by a thumb and forefinger of the user to enable a change of the apparatus from the locked position to the unlocked position. The first extension and the second extension may be each laterally located on the male axle portion. The extensions may be formed from a flexible material. A change of the apparatus from the unlocked position to the locked position may be accomplished via snap-fitting action of the barbs within their corresponding cavities.

All features of the embodiments that are described in this disclosure and that are not mutually exclusive can be combined with one another. Elements of one embodiment can be used in the other embodiments without further mention. These and other aspects and features of the present invention will now become apparent to those of ordinary skill in the art upon review of the following description of embodiments of the invention in conjunction with the accompanying drawings.

BRIEF DESCRIPTION OF THE DRAWINGS

A detailed description of the embodiments of the present invention is provided herein below, by way of example only, with reference to the accompanying drawings.

Figure 1:
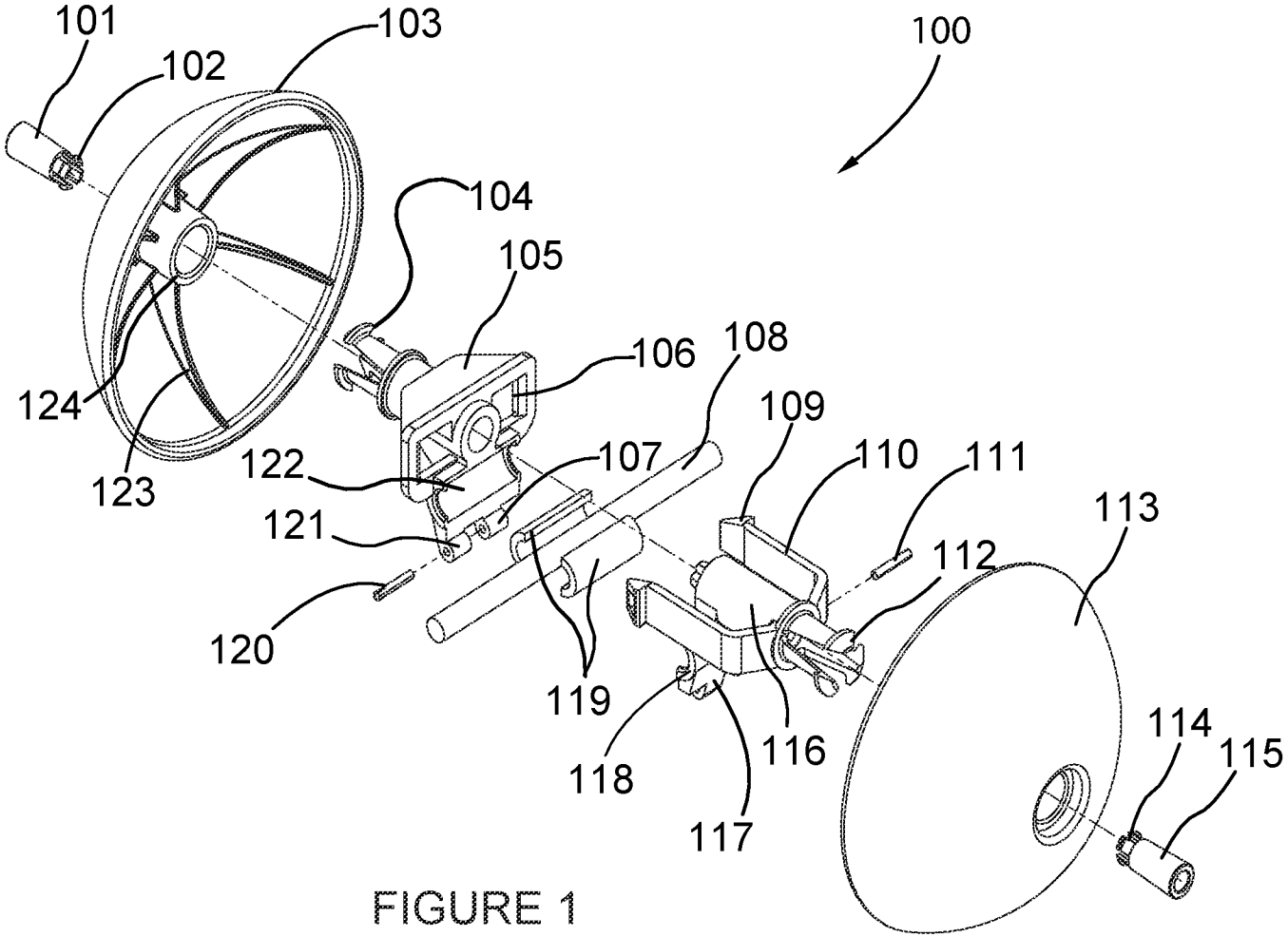
FIG. 1 is an expanded perspective illustration showing an embodiment of the present tether roller apparatus.

In the drawings, embodiments of the invention are illustrated by way of examples. It is to be expressly understood that the description and drawings are only for the purpose of illustration and are an aid for understanding. They are not intended to be a definition of the limits of the invention.

DETAILED DESCRIPTION

To facilitate the description, any reference numeral designating an element in one figure will designate the same element if used in any other figures. In describing the embodiments, specific terminology is resorted to for the sake of clarity, but the invention is not intended to be limited to the specific terms so selected, and it is understood that each specific term comprises all equivalents. Variants, examples, and preferred embodiments of the invention are described hereinbelow.

Before any variants, examples or preferred embodiments of the invention are explained in detail, it is to be understood that the invention is not limited in its application to the details of construction and the arrangement of components set forth in the following description or illustrated in the drawings. The invention is capable of other variants or embodiments and of being practiced or of being carried out in several ways.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional suitable items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down" and "downward" designate directions in the drawings to which reference is made. Similarly, the words "left", "right", "front" and "rear" designate locations or positions in the drawings to which reference is made. The terminology includes the words specifically mentioned above, derivatives thereof, and words or similar import.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate. Unless otherwise defined, all technical and scientific terms used herein have the same meaning as commonly understood by one of ordinary skill in the art.

With reference to FIG. 1, there is shown an expanded perspective illustration of a tether roller apparatus 100 in accordance with an embodiment of the present disclosed invention. The tether roller apparatus 100 forms a generally spherical shape by way of two semi-spherical wheels 103, 113. The wheels 103, 113 are fabricated from a suitably lightweight and durable material such as, but not limited to, acrylonitrile butadiene styrene (ABS), polycarbonate, highdensity polyethylene (HDPE), polyamide-imide (PAI), polyethylene terephthalate glycol (PETG), blends of polyphenylene oxides (PPO) or polyphenylene ether (PPE) resins with polystyrene, polytetrafluoroethylene (PTFE), polyvinylidene fluoride (PVDF), polyphenylsulfone (PPSU), thermoplastic elastomers (TPE). With further regard to the given desired material(s) used to fabricate the wheels and associated parts of the tether roller apparatus, it should be understood that the given environment in which the invention is implemented may of course dictate the material used. For example, a caustic environment may of course require that one or more parts are fabricated from a caustics-resistant polymer. Any such variations are well within the intended scope of the present invention.

Each wheel includes a central hub 124 from which a plurality of reinforcement ribs 123 extend along the inner wheel surface. The hub 124 and ribs 123 are visible with regard to wheel 103 as shown in FIG. 1, though hidden with regard to wheel 113. The ribs provide for structural integrity and increased strength for the cup-like, semi-spherical wheels without adding excessive bulk to the overall structure. The generally hollow, cup-like structure arranged in a spaced apart manner further enables rapid evacuation of dirt or residues between the wheels 103. It should be readily apparent therefore that such configuration helps keep the overall weight of each wheel to a minimum without sacrificing structural strength. The reduction of bulkiness of the wheel structure also advantageously enables its cost-effective, rapid manufacture via any suitable method including, but not limited to, injection molding.

With continued reference to FIG. 1, there are also shown two primary internal parts in the form of a female axle portion 105 and a male axle portion 116 configured to removably attach with one another while maintaining a hinged connection therebetween. The hinged connection is accomplished via pins 111, 120 which are inserted at the time of manufacture when hinge portions 107, 117, 121 are axially aligned to allow insertion of the pins 111, 120. It should be understood that while two pins 111, 120 are shown, a single pin may also be possible. Moreover, any suitable hinge-like mechanism with or without pins may be provided without straying from the intended scope of the present invention. The female axle portion 105 includes a pair of barb accepting cavities 106 into which barbs 109 located on extensions 110 of the male axle portion 116 are capable of lockable insertion. The extensions 110 are themselves semi-flexible so as to allow slight movement of the barb towards and away from the rotational axis (shown by dotted line) of the tether roller apparatus. It should be noted that such lockable insertion may be manually undone (i.e., unlocked) by a user in a manual manner by such slight movement of the barb towards the rotational axis as will be described further hereinbelow with regard to FIG. 4. To prevent each barb 109 from slipping out of its respective barb accepting cavity 106, the barbs 109 have a negative rake angle on their hook-like ends. This also provides the barbs 109 with an ability to lock tighter when under load.

The female axle portion 105 and the male axle portion 116 each include a tether retaining section 122 and 118, respectively as shown. The tether retaining sections may be formed with any additional features that enable secure, non-movable attachment of the tether roller apparatus 100 to a tether 108. Such features may include ridges, projections, teeth, or any additional integrated or separate structure that increases the traction of the surfaces abutting of the tether retaining sections with the tether itself. As shown with regard to the present embodiment, such traction enhancing element may be in the form of a grip layer 119 added atop the surface of the tether retaining sections 118, 122. The grip layer 119 may be a non-slip rubberized material or the like that should be sufficient to grip the tether once the female axle portion 105 and the male axle portion 116 are locked together. The grip layer 119 also serves to advantageously engage the given tether (e.g., flexible cables or electrical tethers in tension) without causing damage to the tether itself (e.g., the tether jacket(s) or internal conductor(s)). It should also be understood that for purposes of illustrative clarity, only a small section of tether 108 is shown, though the tether may of course be of indeterminate length and varied diameter given the particular implementation where the tether roller apparatus is used.

Figure 2:
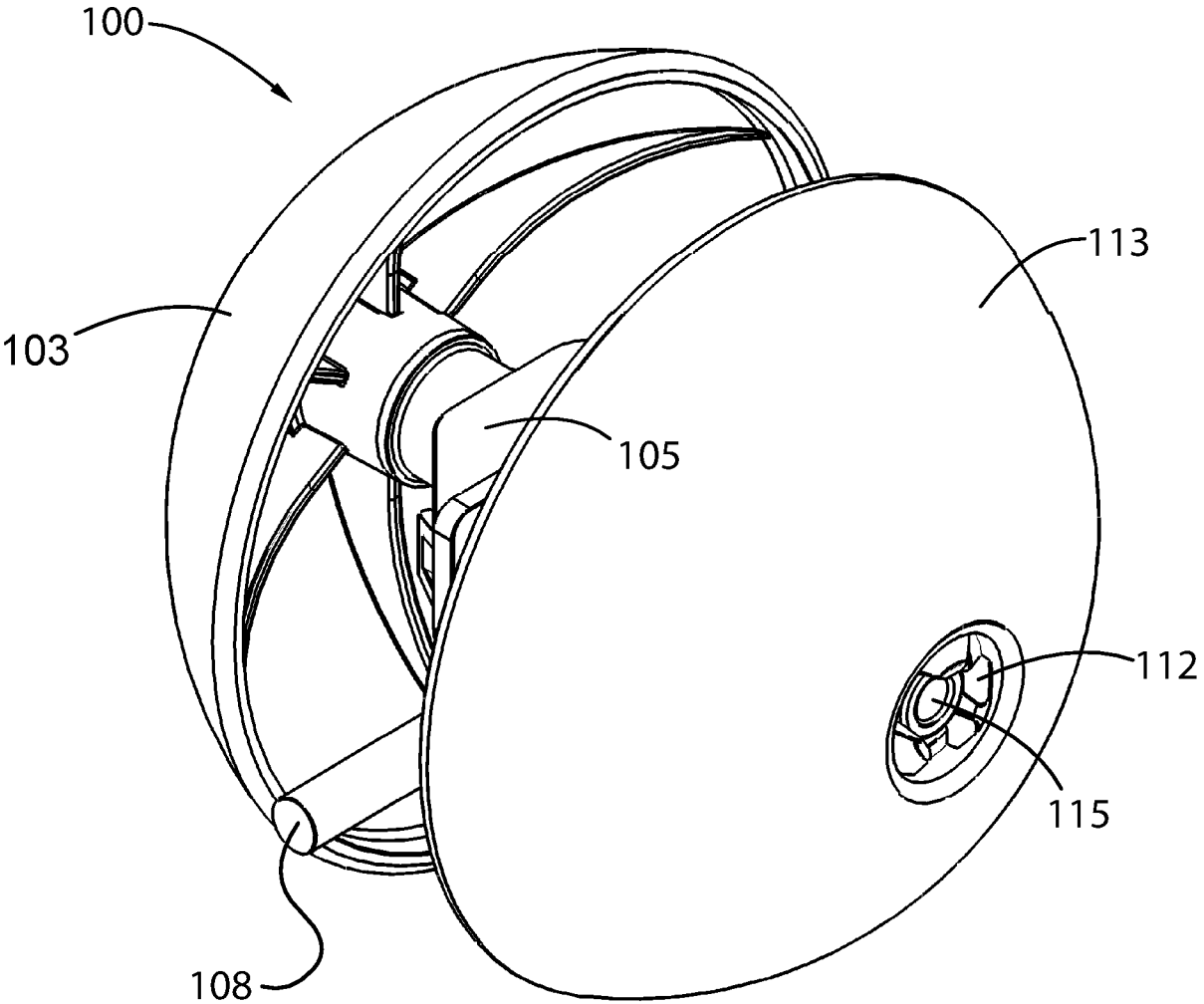
FIG. 2 is an assembled perspective illustration showing the embodiment of the present tether roller apparatus as seen in FIG. 1 and mounted upon a section of a tether.

It should be noted that the tether retaining sections 122 and 118 may be configured to retain a tether having a specific diameter or a range of diameters. For example, the grip layer 119 may be varied in its thickness, compressibility, material, or shape so as to enable tethers of differing diameters being capable of retention within the retaining sections 122 and 118. In terms of tether retention, migration of the tether roller apparatus 100 (when fully assembled as shown by FIG. 2) is precluded linearly along the length of the tether 108 by way of the retaining sections 122 and 118 and the grip layer 119. However, rotational slippage of the tether roller apparatus 100 about the tether 108 may occur and, in certain situations, may be desirable such as when the tether roller apparatus 100 may need to re-orient itself to its normal operating position as further discussed hereinbelow.

In FIG. 1, it is further shown that the female axle portion 105 and the male axle portion 116 each include a barbed axle bearing structure formed by internal bearings 104 and 112 which clip into to each hub 124 where respective external bearings 101 and 115 are clipped into each internal bearings 104 and 112 from the opposite direction in a nesting manner. Each external bearing 101, 115 include bearing connector barbs 102, 114 which mates with an inner circumference of the respective internal bearings 104, 112. It should be understood that once the internal and external bearings are connected to one another in a snap-fit manner, such connection is not intended to be reversible. In this manner, a suitable hub and bearing arrangement is thus formed.

It should further be understood that each wheel hub is rotatable freely about the barbed axle bearing structure once the tether roller apparatus is fully assembled as shown and described with reference to FIG. 2. In terms of material and manner of manufacture, it should be noted that all aforementioned parts of the tether roller apparatus, with the exception of the rubberized grip layer, may be fabricated from materials and in the same method of manufacture as previously described hereinabove with regard to the wheels. With specific reference to FIG. 2 there is shown the tether roller apparatus 100 fully assembled and mounted upon a section of a tether 108. As seen, internal bearing 115 is shown snap fitted into the external bearing 112. Of note is the presence of the female axle portion 105 visible from the open space between the wheels 103, 113. This enables a user to single-handedly access the extensions 110 with the user's thumb and forefinger and thereby unlock the barbs 109 as previously mentioned hereinabove, thus disengaging the tether roller apparatus 100 from the tether 108 by such manual compression of the extensions 110.

Figure 3:
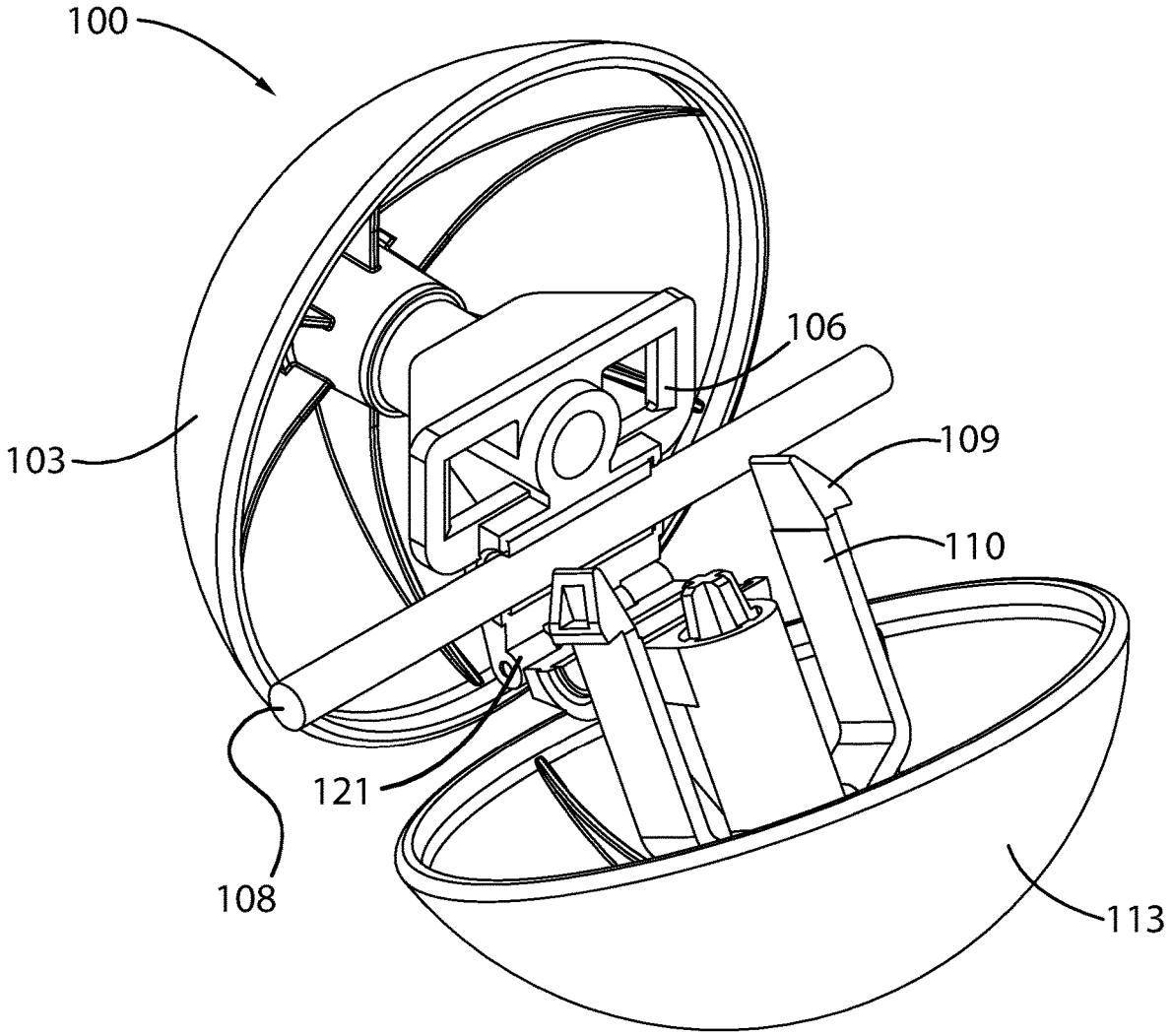
FIG. 3 is an illustration showing the embodiment of the present tether roller apparatus as seen in FIG. 2 and in an unlocked position.

With reference to FIG. 3, there is shown the tether roller apparatus 100 as seen in FIG. 2 but now in an unlocked position whereupon the tether 108 is easily moved out of position relative to the tether roller apparatus 100. Here, the clamshell-like movement of the wheels 103, 113 (along with their rotatably attached female and male axle portions) is readily apparent. This clamshell-like movement is enabled by the hinge portions (portion 121 visible) about which hinge point the two hemispheres (comprising the wheels and the male, female axle portions) are allowed to pivot. Again, this pivoting movement occurs when the user unlocks the barbs 109 from their previously locked position within the cavities 106. The inherent flexibility of the extensions 110 provides for the snap-fit locking action when each barb 109 is inserted into their respective cavity 106. It should be understood that the flexibility inherent to the extensions 110 is a factor of the thickness, length, and choice of material of the extension selected for both material hardness and springiness suitable for retaining each barb in place within its respective cavity in a repeatable locking and unlocking manner.

Figure 4:
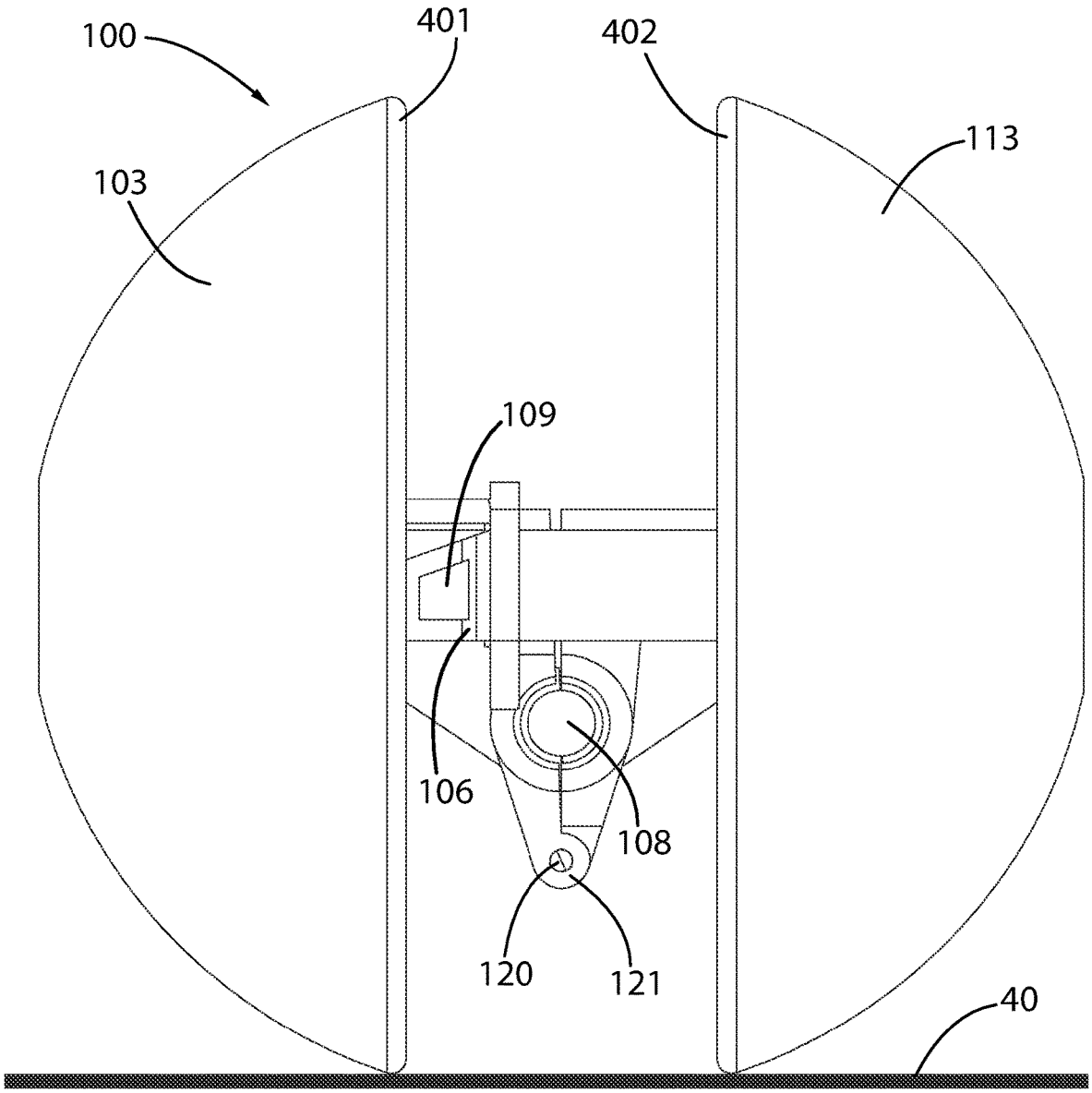
FIG. 4 is an illustration showing the embodiment of the present tether roller apparatus as seen in FIG. 2 taken from an edgewise view.

With reference to FIG. 4, there is shown the tether roller apparatus 100 as seen in FIG. 2 though from the perspective taken from an edgewise view in normal operation upon a surface 40. Here, it should be noted that the bulk of the inner elements (e.g., pin 120, hinge 121) of the tether roller apparatus 100 along with the tether 108 are normally situated below the midway point (i.e., the axis of rotation) of the tether roller apparatus 100 in an off-center, or offset, manner and closer to the given surface (denoted here as line 40) upon which the tether roller apparatus 100 typically rests. Advantageously, this offset enables the center of mass to force the tether roller apparatus 100 into its normal orientation whereby the tether 108 is always in the downward position as shown. Thus, during normal operation, the tether roller apparatus 100 may always right itself to this position such that the bottom of the edges 401, 402 of the wheels 103, 113 are always in contact with the given surface 40. The edges 401, 402 are shown as chamfered. It should be understood that such a bevel edge removes sharp edges for manufacturing and handling and also may allow the wheels to more easily ride atop the given surface by providing less stress on the point of contact with the surface 40. Likewise, the tether placement below the axis of rotation and hinge placement below the tether provides that the loading force on the wheels tends to keep the clamshell-like wheels closed rather than prying them open, thereby maintaining secure attachment to the tether under load.

Still further, in FIG. 4, the advantageous spacing may be clearly seen between the two semi-spherical wheels 103, 113. For purposes of the present disclosure, it should be noted that the term semi-spherical relates to a spherical segment which may be less than half of a sphere. The spacing provides ample open area for the tether 108. Moreover, the spacing provides a useful open area above the tether 108 for a user to manually reach between the wheels 103, 113 and, using their thumb and forefinger, quickly and easily compress the extensions 110 (one shown, one hidden from view) and release the barbs 109 from their respective cavity 106. Upon such quick-release action, the two wheels 103, 113 are then enabled to pivot in a clamshell-like manner with rotation about the pins in the hinge. In this manner, a user may quickly and easily remove, attach, or adjust position of any one of several tether roller apparatuses along the length of the tether.

It should further be understood that the wheels are identical to one another and therefore interchangeable. This facilitates ease of fabrication and ease of assembly. Additionally, the wheels may be any size and may be fabricated as an integral piece or fused pieces that may be independently injection molded, cast, or otherwise manufactured in any suitable mass-producible manner without straying from the intended scope of the present invention. For example, FIG. 5 shows two-piece, fused wheels 201, 203 as one potential variant of the present invention as disclosed, while other such variants may be possible and well within the intended scope of the present invention.

Figure 5:
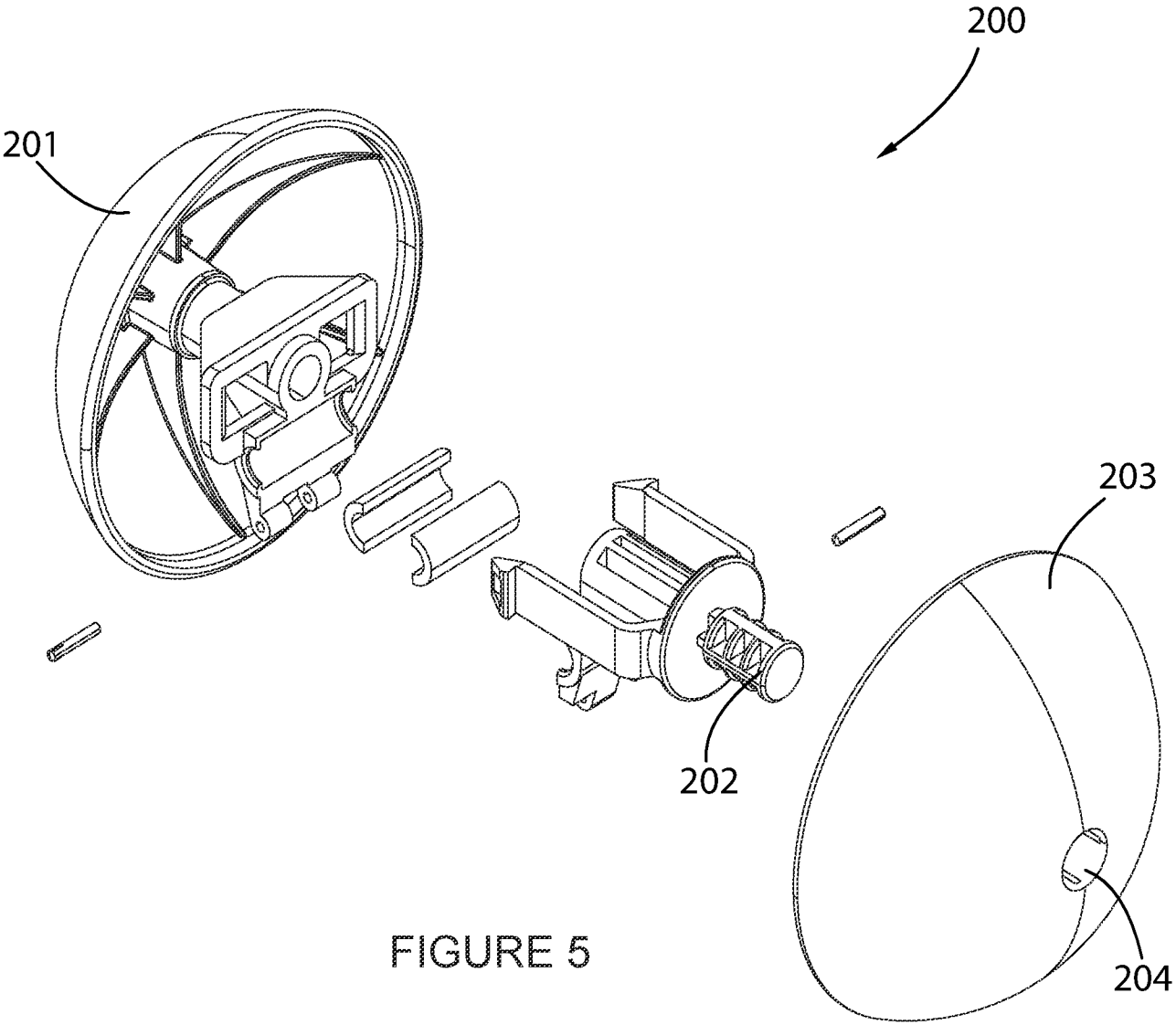
FIG. 5 is an expanded perspective illustration showing an alternative embodiment of the present tether roller apparatus.
Figure 7:
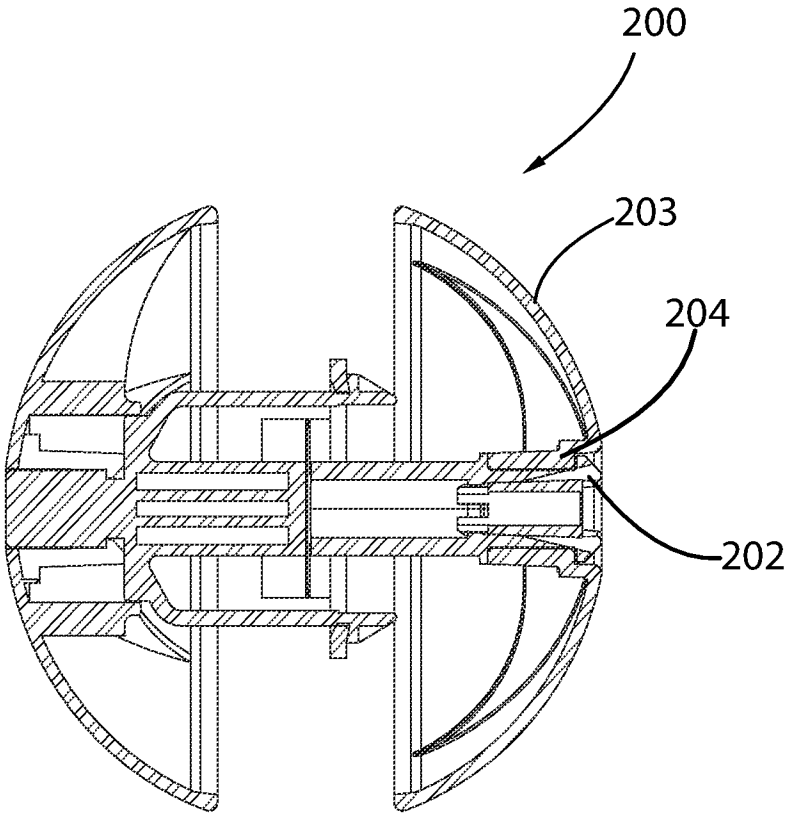
FIG. 7 is a cross section edgewise view of a portion of the alternative embodiment shown in FIG. 5.
Figure 6:
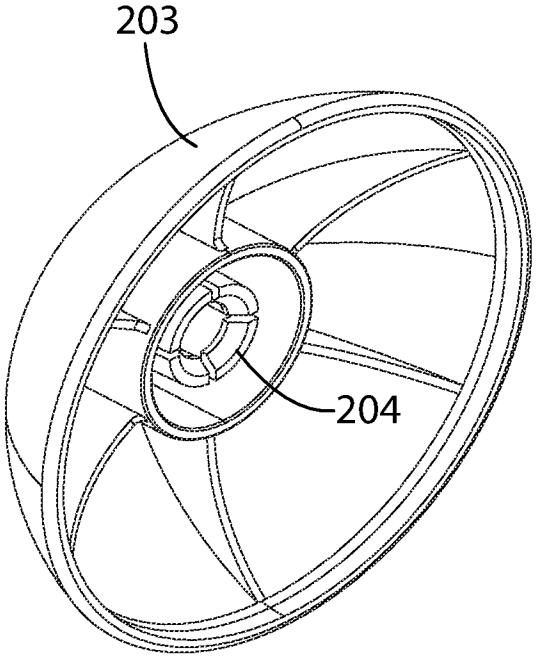
FIG. 6 is a perspective view of a semi-spherical wheel portion of the alternative embodiment shown in FIG. 5.

With further reference to FIG. 5, the alternative tether roller apparatus 200 in accordance with the invention is shown having an alternative manner of rotatably connecting the male and female axle portions to their respective wheels 201, 203. Here, a circumferentially ringed axle bearing structure 202 mates with a barbed inner hub surface 204. As before, once the circumferentially ringed axle bearing structure 202 is snap-fit in a one-way, permanently locked manner into the barbed inner hub surface 204, the wheel 203 is able to freely rotate about the circumferentially ringed axle bearing structure 202. It should be understood that many different variations of a snap-fit, freely rotating axle/hub configuration may also be possible without straying from the intended scope of the present invention. With reference to FIG. 6, the inner view of the alternative semi-spherical wheel 203 may be seen showing the circumferentially barbed inner hub surface 204 as mentioned. Likewise, with reference to FIG. 7, a cross section edgewise view of the circumferentially ringed axle bearing structure 202 is shown detailing the manner in which the wheel 203 is snap-fit onto the circumferentially ringed axle bearing structure 202 at the connection with the circumferentially barbed inner hub surface 204.

Figure 8:
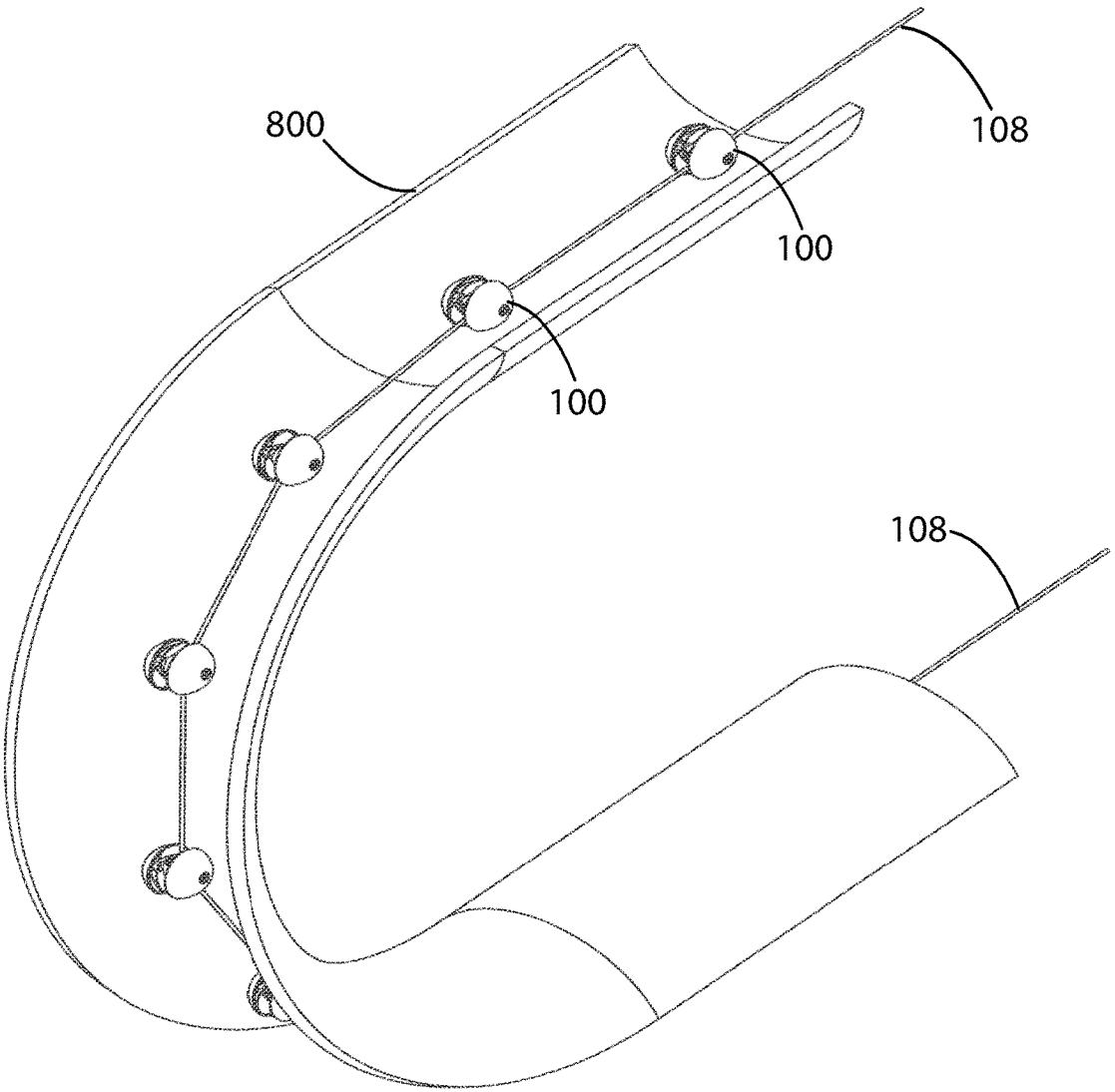
FIG. 8 is a perspective illustration of multiple instances of the assembled tether roller apparatus of FIG. 2 shown in use along a curved track and attached at intervals to a section of tether.

As previously mentioned, a user may quickly and easily remove, attach, or adjust the position of any one of several tether roller apparatuses along the length of the tether. With reference to FIG. 8, this aspect is shown whereby multiple instances of the assembled tether roller apparatus 100 of FIG. 2 are shown in use along a curved track 800 illustrative of an inner surface of a curved pipe or conduit. Here, each tether roller apparatus 100 is attached at intervals to a section of the tether 108 in order to hold the tether away from the inner surface of the curved track 800 thereby substantially eliminating friction and associated capstan effect. The intervals may vary depending on the curvature of the surface(s) encountered in any given field implementation. For example, for implementations where a tight bend radius exists, the wheels may be placed close together to prevent the tether from contacting the pipe surface. Likewise, in an implementation where a long bend radius exists, the wheels may be placed further apart. Advantageously, a user may vary these intervals as needed, when needed, and in a customizable manner quickly and without the need for any specialized tools. Moreover, the present invention has the advantage that no loose parts (e.g., screws, bolts, or removable fasteners of any type) or extraneous tools (e.g., wrenches, screwdrivers, ratchets, or the like) are needed for connecting or detaching each tether roller apparatus 100.

The tether roller apparatus in accordance with the present invention is therefor advantageous in many various implementations including, but not limited to, replacing known methods of corner sliding friction with rolling wheels allowing much further penetration of a tethered device (e.g., an inspection robot or the like) into a piping system or around cylindrical tanks in an industrial setting such as a plant floor. Moreover, the overall spherical shape of the tether roller apparatus advantageously enables the apparatus to function regardless of the direction of contact or direction of the pull from the tether. As well, the manner by which the tether roller apparatus is attached advantageously occurs without damage to any tether jacket or any internal conductors such as within a multi-conductor electrical tether or the like.

The above description is considered as illustrative only of the principles of the invention. As numerous modifications and changes will become readily apparent to those skilled in the art in light of the present description, it is not desired to limit the invention to the exact examples and embodiments shown and described, and accordingly, suitable modifications and equivalents may be resorted to. It is understood by those skilled in the art that throughout the present specification, the term "a" used before a term encompasses embodiments containing one or more to what the term refers. It will also be understood by those skilled in the art that throughout the present specification, the term "comprising," which is synonymous with "including," "having" or "containing" is inclusive or open-ended and does not exclude additional, un-recited elements or method steps.

The above description of the embodiments should not be interpreted in a limiting manner since other variations, modifications and refinements are possible within the scope of the present invention. Accordingly, various features and aspects of the disclosed embodiments can be combined with or substituted for one another to form varying modes of the disclosed invention. The scope of the invention is defined in the appended claims and their equivalents.

The invention claimed is:

1. A tether roller apparatus for maintaining a tether at a distance from a curved surface, the apparatus comprising:

a pair of semi-spherical wheels;

a female axle portion rotatably coupled to one of the pair of semi-spherical wheels;

a male axle portion rotatably coupled to another of the pair of semi-spherical wheels; and a hinge for pivotably coupling the female axle portion and the male axle portion;

wherein the female axle portion and the male axle portion are movable about the hinge between a locked position thereby immovably engaging a tether and an unlocked position thereby disengaging the tether.

2. The apparatus as claimed in claim 1, further including a tether retaining section formed by the female axle portion and the male axle portion.

3. The apparatus as claimed in claim 2, wherein the tether retaining section is a grip layer comprised of a non-slip material.

4. The apparatus as claimed in claim 3, wherein the female axle portion includes at least one cavity and the male axle portion includes at least one barb mounted at an end of an extension, the at least one barb releasably connecting with the at least one cavity.

5. The apparatus as claimed in claim 4, wherein the pair of semi-spherical wheels are separated by a gap, and the at least one extension is accessible via the gap by a user of the apparatus.

6. The apparatus as claimed in claim 5, wherein the tether retaining section is offset from an axis about which the pair of semi-spherical wheels rotate.

7. The apparatus as claimed in claim 6, wherein the male axle portion includes a first barb mounted at an end of a first extension and a second barb mounted at an end of a second extension and, correspondingly, the female axle portion includes a first cavity and a second cavity, where the first barb and the first cavity when connected to one another are located opposite the axis from the second barb and the second cavity when connected to one another.

8. The apparatus as claimed in claim 7 wherein the first extension and the second extension are compressible by a thumb and forefinger of the user to enable a change of the apparatus from the locked position to the unlocked position.

9. The apparatus as claimed in claim 8 wherein the first extension and the second extension are each laterally located on the male axle portion.

10. The apparatus as claimed in claim 8 wherein the extensions are formed from a flexible material.

11. The apparatus as claimed in claim 8 wherein a change of the apparatus from the unlocked position to the locked position is accomplished via snap-fitting action of the barbs within their corresponding cavities.

12. The apparatus as claimed in claim 8 wherein the tether retaining section is integrally formed with surfaces of the female axle portion and the male axle portion.

* * * * *